US011454037B1

(12) United States Patent
Huss

(10) Patent No.: US 11,454,037 B1
(45) **Date of Patent: *Sep. 27, 2022**

(54) INTERLOCKING MODULAR MAT WITH SPONGE INSERT

(71) Applicant: Wearwell, LLC, Smyrna, TN (US)

(72) Inventor: Philip C. Huss, Smyrna, TN (US)

(73) Assignee: Wearwell, LLC, Smyrna, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/858,246

(22) Filed: Jul. 6, 2022

Related U.S. Application Data

(63) Continuation of application No. 17/523,144, filed on Nov. 10, 2021, which is a continuation of application No. 16/839,101, filed on Apr. 3, 2020, now Pat. No. 11,174,648, which is a continuation of application No. 15/843,494, filed on Dec. 15, 2017, now Pat. No. 10,914,081.

(51) Int. Cl.

| | |
|---|---|
| ***E04F 15/22*** | (2006.01) |
| ***E04F 15/10*** | (2006.01) |
| ***A47G 27/02*** | (2006.01) |
| ***E04F 15/02*** | (2006.01) |

(52) U.S. Cl.

CPC ..... *E04F 15/225* (2013.01); *A47G 27/0218* (2013.01); *A47G 27/0293* (2013.01); *E04F 15/02038* (2013.01); *E04F 15/105* (2013.01); *E04F 15/107* (2013.01); *E04F 15/02172* (2013.01); *E04F 2201/0138* (2013.01); *E04F 2201/021* (2013.01); *E04F 2201/091* (2013.01); *E04F 2201/095* (2013.01); *E04F 2201/096* (2013.01); *E04F 2290/044* (2013.01)

(58) Field of Classification Search

CPC ..... E04F 15/187; E04F 15/225; E04F 2201/0107; E04F 2201/09; E04F 2201/096; E04F 15/02172; E04F 15/02038; E04F 2201/021; A47G 27/0218; E01C 13/045; E01C 2201/12

See application file for complete search history.

(56) References Cited

U.S. PATENT DOCUMENTS

| | | | |
|---|---|---|---|
| 3,701,214 | A | 10/1972 | Sakamoto |
| 4,147,828 | A | 4/1979 | Heckle et al. |
| 4,242,767 | A | 1/1981 | McMullen et al. |
| 4,287,693 | A | 9/1981 | Collette |
| 4,361,614 | A | 11/1982 | Moffitt, Jr. |
| 4,584,221 | A | 4/1986 | Kung |

(Continued)

*Primary Examiner* — Gisele D Ford

(74) *Attorney, Agent, or Firm* — Clark & Brody LP

(57) ABSTRACT

An interlocking modular mat having four sides has female connectors on two sides and male connectors on the other two sides so that the modular mat can interlock with an adjacent mat and its connectors. The modular mat is configured with a plurality of structures surrounding a periphery of a top portion of the mat. The plurality of structures in combination with an underside of the top portion of the mat form a cavity. A sponge insert is configured to fit in the cavity and have a height such that a portion of the sponge insert extends from a bottom side the mat body. With the sponge insert extending beyond the bottom side of the mat body, the sponge insert bottom face generally become the supporting bottom of the modular mat to provide a more cushioned feel for a mat user.

14 Claims, 10 Drawing Sheets

(56) References Cited

U.S. PATENT DOCUMENTS

| | | | |
|---|---|---|---|
| 4,590,731 | A | 5/1986 | DeGooyer |
| 4,603,852 | A | 8/1986 | Breitscheidel et al. |
| 4,648,592 | A | 3/1987 | Harinishi |
| 4,860,510 | A | 8/1989 | Kotler |
| 5,052,158 | A | 10/1991 | O'Luzansky |
| 5,212,842 | A | 5/1993 | Glydon |
| 5,562,573 | A | 10/1996 | Harinishi |
| 5,950,378 | A | 9/1999 | Council |
| 6,098,354 | A | 8/2000 | Skandis |
| 6,451,400 | B1 | 9/2002 | Brock |
| 6,802,159 | B1 | 10/2004 | Kotler |
| 6,878,430 | B2 | 4/2005 | Milewski |
| 6,921,502 | B1 | 7/2005 | Nord |
| 7,211,314 | B2 | 5/2007 | Nevison |
| 7,676,995 | B2 | 3/2010 | Vanderhoef |
| 7,698,859 | B2 | 4/2010 | Sansano |
| 7,832,044 | B2 | 11/2010 | Kessler |
| 7,908,802 | B2 | 3/2011 | Frederiksen |
| 8,006,443 | B2 | 8/2011 | Fuccella et al. |
| 8,020,783 | B2 | 9/2011 | Backman |
| 8,266,857 | B2 | 9/2012 | David |
| D681,993 | S | 5/2013 | Huss |
| D696,874 | S | 1/2014 | Huss |
| D704,961 | S | 5/2014 | Huss |
| 8,756,882 | B1 | 6/2014 | Vachon |
| 8,806,822 | B1 | 8/2014 | Wang |
| 8,833,007 | B2 | 9/2014 | Tillery et al. |
| 8,881,482 | B2 | 11/2014 | Cerny |
| 8,919,054 | B2 | 12/2014 | Tillery et al. |
| D740,591 | S | 10/2015 | Huss |
| 9,180,640 | B2 | 11/2015 | Masanek |
| 9,247,839 | B2 | 2/2016 | Tillery et al. |
| 9,631,375 | B1 * | 4/2017 | Barlow ..... E04F 15/225 |
| 9,771,725 | B2 | 9/2017 | Matchung |
| 9,863,155 | B2 | 1/2018 | Cerny |
| 9,914,011 | B2 | 3/2018 | Downey |
| 10,190,324 | B2 | 1/2019 | Julton |
| 10,674,701 | B2 | 6/2020 | Kramer |
| 2002/0119275 | A1 | 8/2002 | Williamson |
| 2002/0189176 | A1 | 12/2002 | Stegner |
| 2003/0131549 | A1 | 7/2003 | Kappeli |
| 2005/0193669 | A1 | 9/2005 | Jenkins |
| 2005/0252109 | A1 | 11/2005 | Fuccella |
| 2005/0258564 | A1 | 11/2005 | Nevison |
| 2006/0070314 | A1 | 4/2006 | Jenkins |
| 2006/0081159 | A1 | 4/2006 | Chapman |
| 2006/0127647 | A1 | 6/2006 | Thrush |
| 2006/0272252 | A1 | 12/2006 | Moller |
| 2006/0283118 | A1 | 12/2006 | Moller |
| 2006/0283125 | A1 | 12/2006 | Moller |
| 2007/0223993 | A1 | 9/2007 | Peterson |
| 2007/0261317 | A1 | 11/2007 | Moller |
| 2007/0289244 | A1 | 12/2007 | Haney |
| 2009/0031658 | A1 | 2/2009 | Moller |
| 2009/0047451 | A1 | 2/2009 | Huss |
| 2009/0235605 | A1 | 9/2009 | Haney |
| 2009/0239021 | A1 | 9/2009 | Wise |
| 2009/0266022 | A1 | 10/2009 | Lin |
| 2010/0151220 | A1 | 6/2010 | Bowmar |
| 2010/0275541 | A1 | 11/2010 | Prinz |
| 2011/0011020 | A1 | 1/2011 | Shen |
| 2011/0104434 | A1 | 5/2011 | Masanek |
| 2011/0185658 | A1 | 8/2011 | Cerny |
| 2011/0252730 | A1 | 10/2011 | Rosan |
| 2013/0017372 | A1 | 1/2013 | Mechling et al. |
| 2013/0071625 | A1 | 3/2013 | Masanek |
| 2013/0086861 | A1 | 4/2013 | Masanek |
| 2013/0086869 | A1 | 4/2013 | Couturier |
| 2013/0095295 | A1 | 4/2013 | Masanek |
| 2013/0165243 | A1 | 6/2013 | Reising |
| 2013/0291457 | A1 | 11/2013 | Tillery et al. |
| 2013/0291474 | A1 | 11/2013 | Tillery |
| 2015/0075092 | A1 | 3/2015 | Moller |
| 2015/0251375 | A1 | 9/2015 | Lin |
| 2015/0252563 | A1 | 9/2015 | Cerny |
| 2015/0284965 | A1 | 10/2015 | Hurson |
| 2015/0315801 | A1 | 11/2015 | Amend |
| 2015/0376904 | A1 | 12/2015 | Huss |
| 2016/0138275 | A1 | 5/2016 | Cormier |
| 2016/0222674 | A1 | 8/2016 | Cerny |
| 2016/0255977 | A1 | 9/2016 | Burkhalter |
| 2016/0375296 | A1 | 12/2016 | Downey |
| 2017/0101789 | A1 | 4/2017 | Cormier |
| 2017/0175389 | A1 | 6/2017 | Liang |
| 2017/0226707 | A1 | 8/2017 | Hassan |
| 2017/0295977 | A1 | 10/2017 | Thrush |
| 2018/0073253 | A1 | 3/2018 | Hainbach |
| 2018/0073254 | A1 | 3/2018 | Hainbach |
| 2018/0080235 | A1 | 3/2018 | Downey |
| 2018/0178484 | A1 | 6/2018 | Evans Hurson |
| 2018/0305872 | A1 | 10/2018 | Son |

* cited by examiner

INTERLOCKING MODULAR MAT WITH SPONGE INSERT

FIELD OF THE INVENTION

The present invention is generally directed to an interlocking modular mat that employs a sponge insert that resides in a cavity formed by a top portion of the mat and a plurality of structures extending around a periphery of the mat.

BACKGROUND ART

Modular floor mats or tiles are often used as components on the construction of a flooring system. A mat or tile system may be designed as a floor covering for an entire room, or a floor covering for a section of a room. Typically, the mat or tile system components may be manufactured from, for example, semi-rigid, plasticized, virgin polyvinyl chloride, virgin/reclaimed polyvinyl chloride mixtures and also materials such as recycled rubber, or from compression molded thermoplastic materials such as, thermoplastic polyurethane (TPU), or thermoplastic rubber, for example. Other materials include thermoplastic co-polyesters or thermoplastic polyamides, elastomeric alloys, polyolefin blends (TPE-o) and the like.

The mat or tile system, when used as a floor or ground covering, is suitable to withstand inclement weather, harsh environments, heavy traffic, and resist damage when exposed to harsh chemicals. Primary uses for the modular floor tiles of the present invention include providing lateral support, and providing comfort and reduction of fatigue during walking or standing. In the prior art, the use of molded mats, e.g., polyurethane foam molded mats, in industrial and commercial applications is well known. These foam mats are advantageous because of the resiliency and cushioned support that the foam provides for workers when the workers are engaging in tasks that require an excessive amount of standing in a given location.

Various types of modular floor tiles have increased in popularity due to their versatility. A free-standing modular floor mat system typically provides a non-slip modular system that optionally is self-draining and has multiple configuration capabilities.

The mat system is typically assembled from mat elements or units, herein referred to as mat or tiles. Typically, each mat or tile comprises interlocking members which connect adjacent panel members. Male and female portions are typically employed in the form of hole and peg structures, such as set forth in patents no. U.S. Pat. No. 8,006,443, or in jigsaw or tooth type structures as exemplified in U.S. Pat. No. 4,287,693. Conventionally, mats or tiles are assembled into a structure covering a floor or surface with a shape adapted to the intended shape of the mat or tile system. For example, the assembled mat or tile system can be simply a closed rectangular shape or a rectangular shape with inner open areas, or any overall shape that can be constructed with mat panel or tile member structures.

These types of mats often have supporting structures that underlie the top portion of the mat. An example of this kind of construction is U.S. Pat. No. 8,006,443, which is incorporated by reference in its entirety, including materials, construction, methods of making and methods of use. These structures tend to give the mat a rigid or hard feel that can increase the fatigue of a person standing on the mat for long periods of times. As such, a need exists for modular mats with softer feels while still maintaining the integrity of the modular mat and ability to interconnect to adjacent mats.

SUMMARY OF THE INVENTION

The invention relates to an improved interlocking modular mat and method of use.

One embodiment of the interlocking modular mat comprises a mat body, the mat body having a top portion, the top portion having four sides, first and second sides of the four sides including a set of female connectors and third and fourth sides of the four sides including a set of male connectors, each female connector configured to interface with a male connector of an adjacent interlocking modular mat so that a side of the interlocking modular mat with the female connectors can connect to a side of an adjacent interlocking modular mat having male connectors.

The mat body includes a plurality of structures extending from an underside of the top portion and around a periphery of the top portion, the structures forming a cavity with the underside of the top portion. A sponge insert is provided, the sponge insert sized to fit within the cavity formed in the mat body, the sponge insert having a height dimension such that when inserted in the cavity, a bottom portion of the sponge insert extends beyond a bottom of the plurality of structures extending from an underside of the top portion of the mat body as well as bottoms of the female and male connectors.

At least some of the plurality of first wall structures positioned along the first and second sides can have a female connector extend therefrom.

For the plurality of second spaced apart wall structures extending along the third and fourth sides, the second spaced apart second wall structures are arranged so that a male connector is positioned between adjacent second spaced apart wall structures.

In one embodiment, the sponge insert periphery forms a continuous wall to engage at least a portion of the plurality of structures forming the cavity. In another embodiment, the sponge insert has cutout portions along a periphery thereof for the first wall structures associated with the female connectors and the male connectors.

In a further embodiment, the plurality of structures can include a protrusion having a free end extending toward a center of the mat body, the free ends of each protrusion aligned to define a periphery of the cavity for the sponge insert.

The wall structures can be hollow rectangular structures with reinforcing ribs or in the shape of a wall as an extension of the top portion of the mat body.

The invention also includes a method of interlocking the modular mats together to form a mat assembly of desired size. In this method, a plurality of the interlocking modular mats are provided. Then, female connectors of one mat body are connected to the male connectors of another mat body and this sequence of interlocking is continued for a number of mat bodies until the mat assembly of desired size is formed.

DETAILED DESCRIPTION OF THE INVENTION

Figure 1:
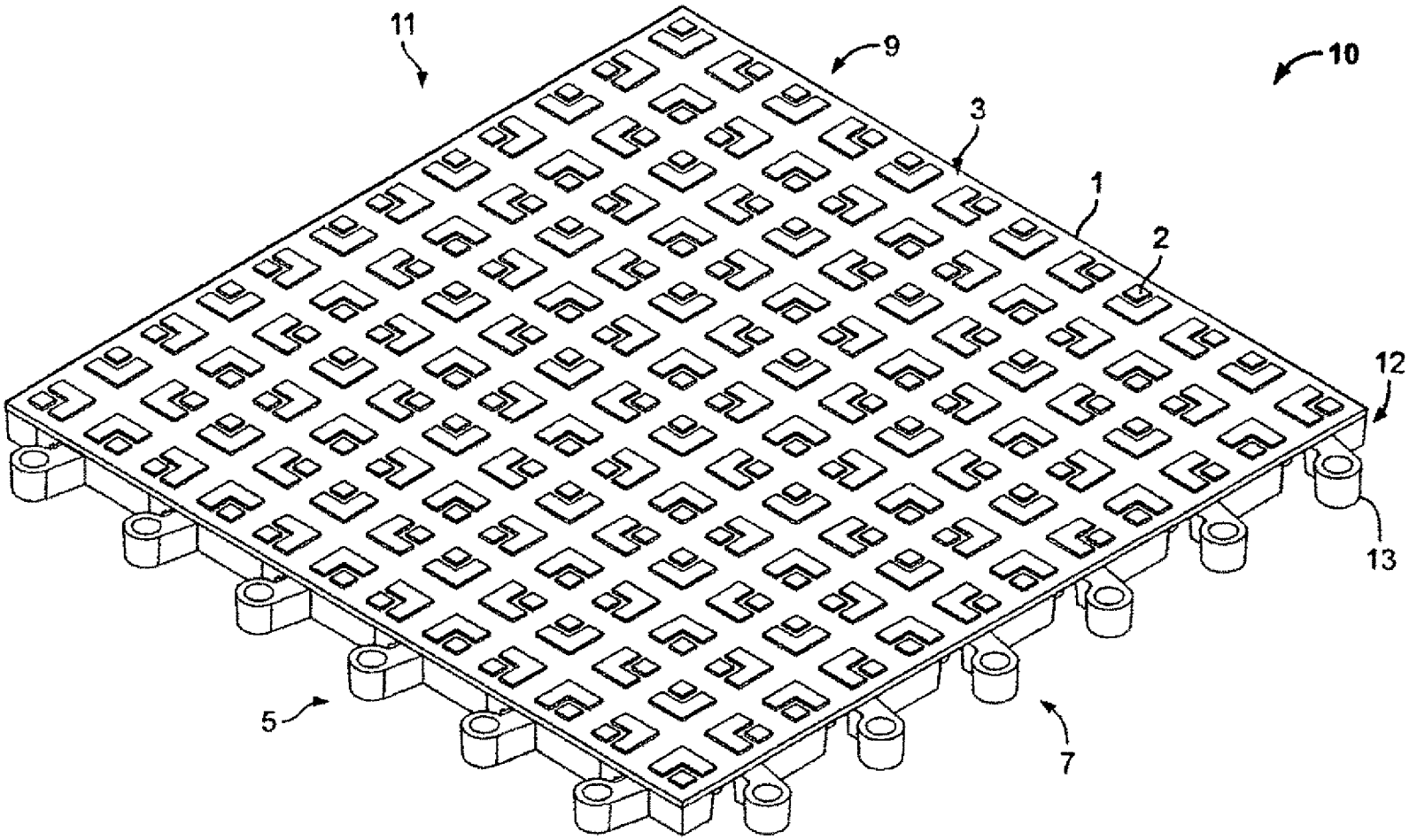
FIG. 1 is a perspective view of a top of one embodiment of the interlocking modular mat showing the female connector sides thereof.

A first embodiment of the inventive interlocking modular mat, hereinafter the modular mat, is designated by the reference numeral 10 and depicted in FIGS. 1-7. FIG. 1 shows a top perspective view of the modular mat 10. The modular mat has a mat body 1 with a top portion 2 that includes a tread design 3 thereon. The tread design is only an example of a tread design and any known design can be molded into the mat. The modular mat has four sides 5, 7, 9, and 11. Sides 5 and 7 include spaced apart female connectors 13 extending from a periphery 12 of the modular mat 10.

Figure 2:
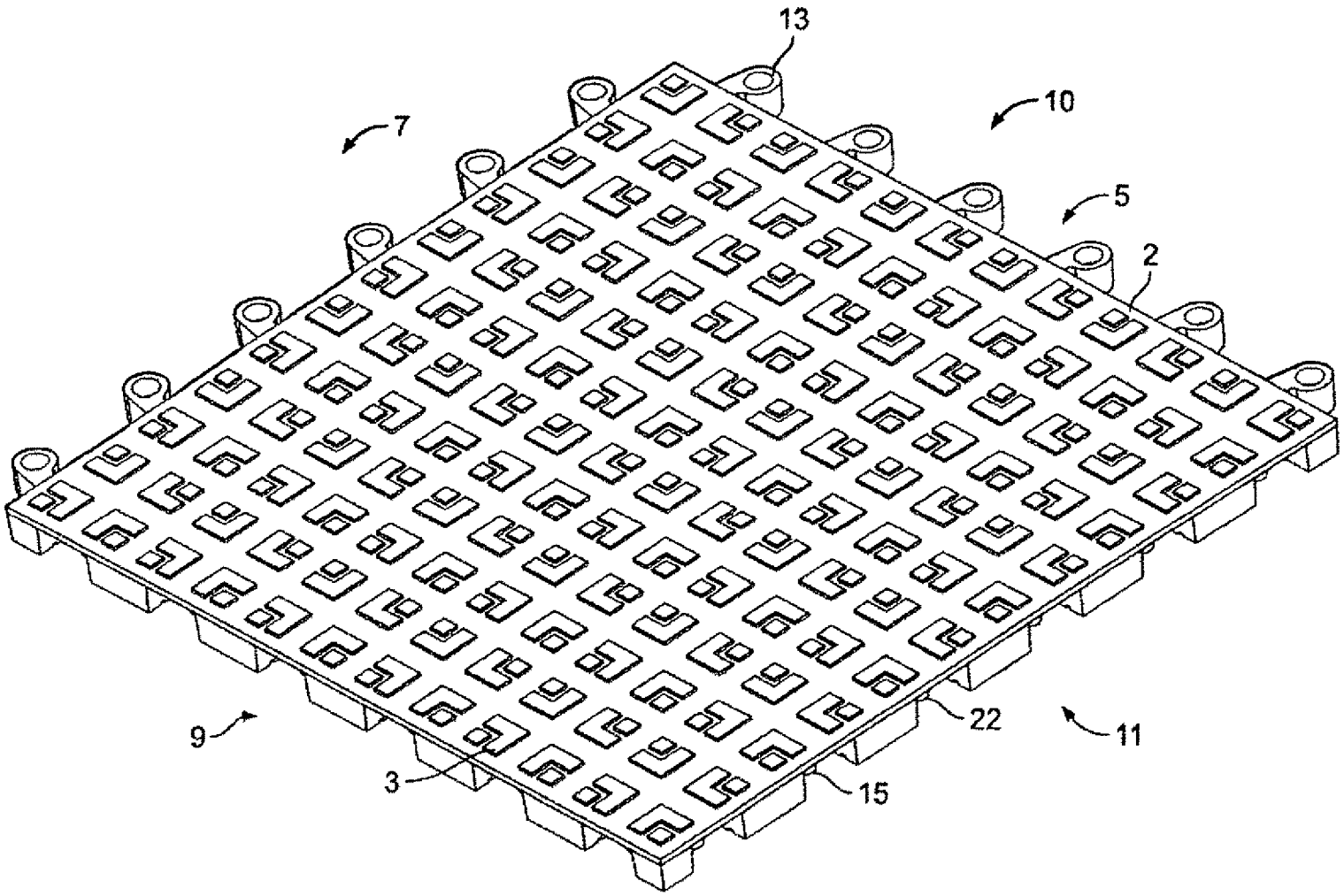
FIG. 2 is another perspective view of the top of the mat of FIG. 1 showing the male connector sides of the interlocking modular mat.
Figure 3:
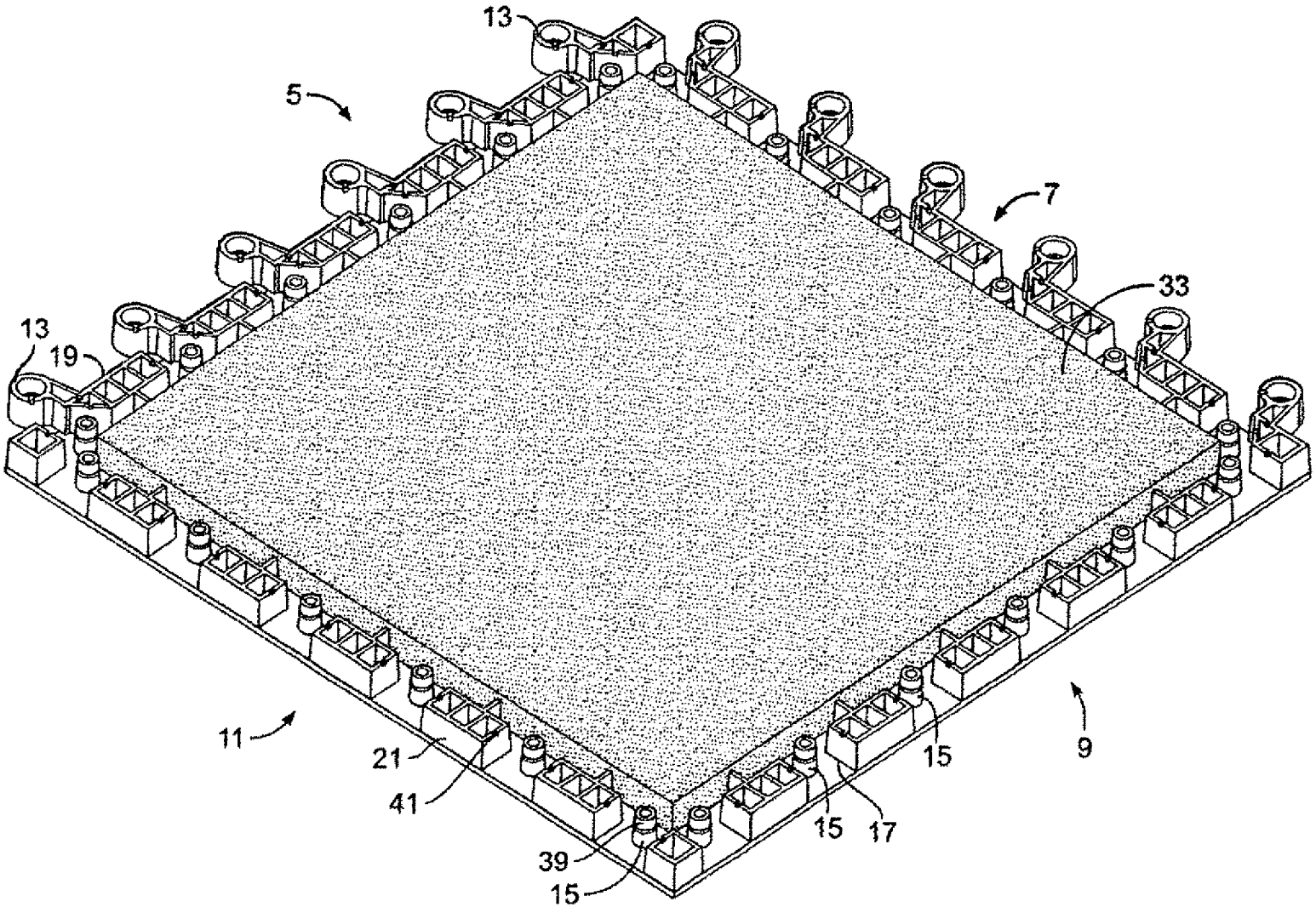
FIG. 3 shows a perspective view of the underside of the interlocking modular mat of FIG. 1.

With reference to FIGS. 2 and 3, sides 9 and 11 include spaced apart male connectors 15. The male connectors extend from an underside 17 of the top portion 2 of the mat body 1. While male connectors 15 are also shown on sides 5 and 7 with the female connectors 13, these male connectors are optional as they would not function in a connecting capacity due to the presence and use of the female connectors 13 to link to the male connectors of an adjacent modular mat.

Wall structures 19 are provided that are also spaced apart along the sides 7 and 9 of the mat body 1. The wall structures 19 function, in one mode, as an anchor for the female connectors 13. Similarly, the male connector sides 9 and 11 have spaced apart wall structures 21 to allow access to the male connectors 15 via gap 22. In the FIG. 1-7 embodiment, each of the wall structures 19 and 21 include a protrusion 23 and 25. Each protrusion 23 and 25 extends inwardly toward a center of the modular mat 10 from an inward wall 27, and 29, respectively of the female connector wall structure 19 and male connector side wall structure 21.

While the wall structures 19 that provide a mounting location for the female connectors 13 are spaced apart, the wall structures could extend along the entirety of the two sides 5 and 7. For example, if the male connectors 15 positioned along sides 7 and 9 were not needed, the space shown in FIG. 4 for example between adjacent wall structures 19 would not be necessary; the wall structures associated with the female connectors 13 could extend along the entirety of sides 7 and 9.

Figure 6:
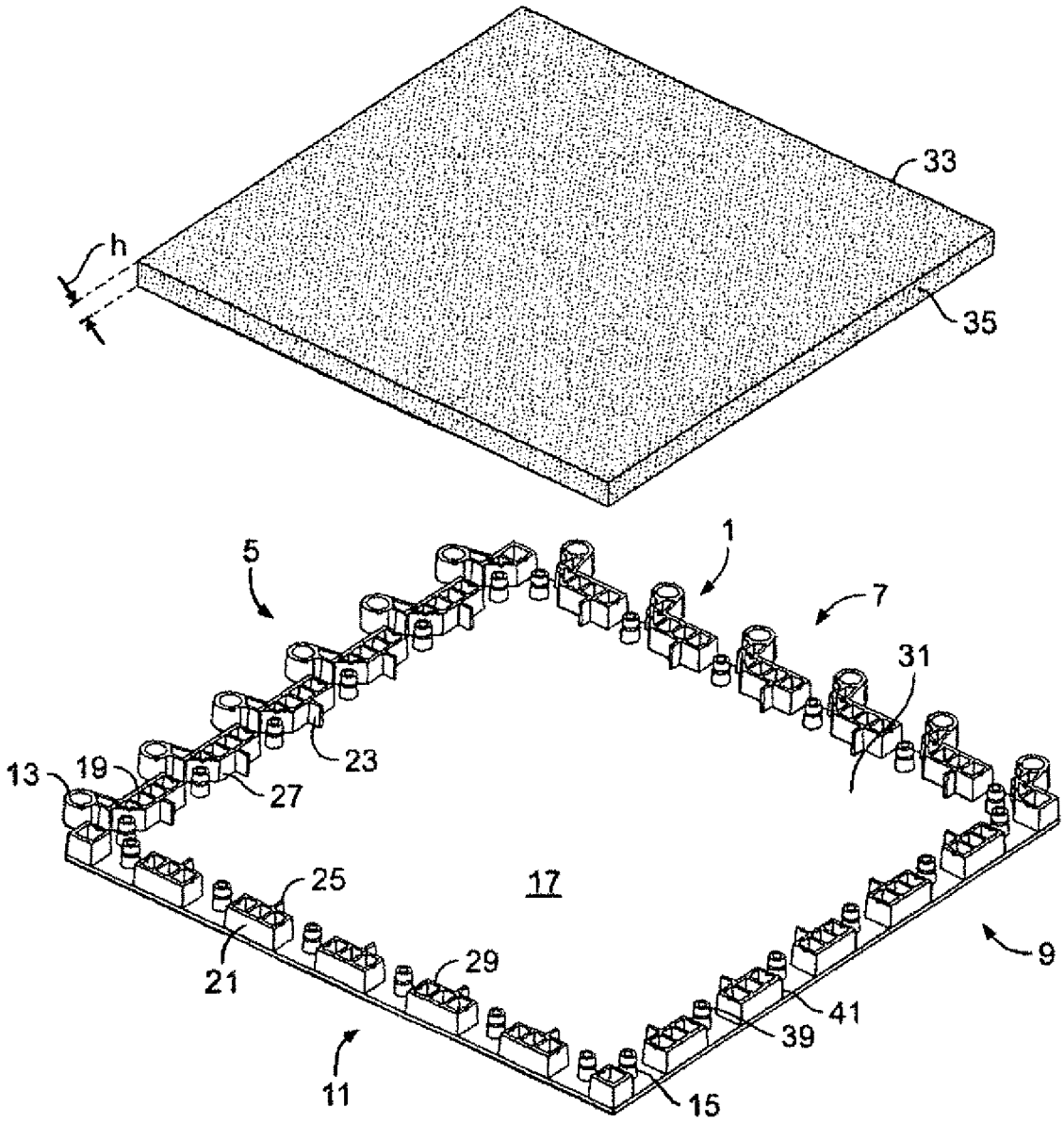
FIG. 6 shows an exploded perspective view of the interlocking modular mat with the sponge insert removed from the cavity of the interlocking modular mat.

The walls structures 19 and 21 along with the underside 17 of the top portion 1 form a cavity 31, see FIG. 6. Thus, the wall structures 19 have a dual capacity in aiding in the mounting or anchoring of the female connectors 13 to the modular mat 10 and forming the cavity 31. The wall structures 21 on the male connector sides 9 and 11 function to define the cavity for these sides of the modular mat 10.

Still referring to FIG. 6, a sponge insert 33 is provided and sized to fit within the cavity 31 so that the edge wall 35 thereof is adjacent to free ends of the protrusions 23 and 25. The protrusions 23 and 25 act as seats to help position the sponge insert in the cavity 31. It should be understood that the protrusions 23 and 25 are exemplary configurations of the wall structures that assist in seating or positioning the sponge insert and other configurations could be used, e.g., just the walls 27 and 29 could be employed without any protrusions.

The sponge material is dimensioned in height h, see FIG. 6, so that when positioned in the cavity 31, it extends beyond a bottom surface 37 of the wall structures 19 and female connectors 13, and a bottom surface 39 of male connectors 15 (see FIG. 3), and a bottom surface 41 of the wall structures 21. The amount of extension is designated by the reference numeral 40 in FIG. 6. While the amount of extension can vary, it should be at least a minimum of about ⅛ inch. Otherwise, the cushioning effect of the sponge insert is lost. Put another way, the height h of the sponge insert is greater than a distance from the underside 17 of the top portion to the bottom surfaces of the various parts of the mat body. If the lengths for these components should vary, e.g., the male connectors do not extend as far from the underside of the top portion as the female connector wall structures 19 extend, the height h will be longer than the component having the most extension from the underside 17 of the top portion 2.

The purpose of having the height of the sponge insert 33 to extend beyond an underside of the modular mat as shown in FIG. 6 is to give the modular mat 10 a more cushioned feel without losing the structural integrity that the mat has due to the wall structures extending around the periphery 12 of the mat. That is, the underside of the sponge insert acts as the primary base of the modular mat as opposed to the bottom surfaces of the various parts of the mat body 10. Situating the sponge insert 33 in the cavity also preserves the use of the female and male connectors, which are molded parts of the mat body 10.

Figure 12:
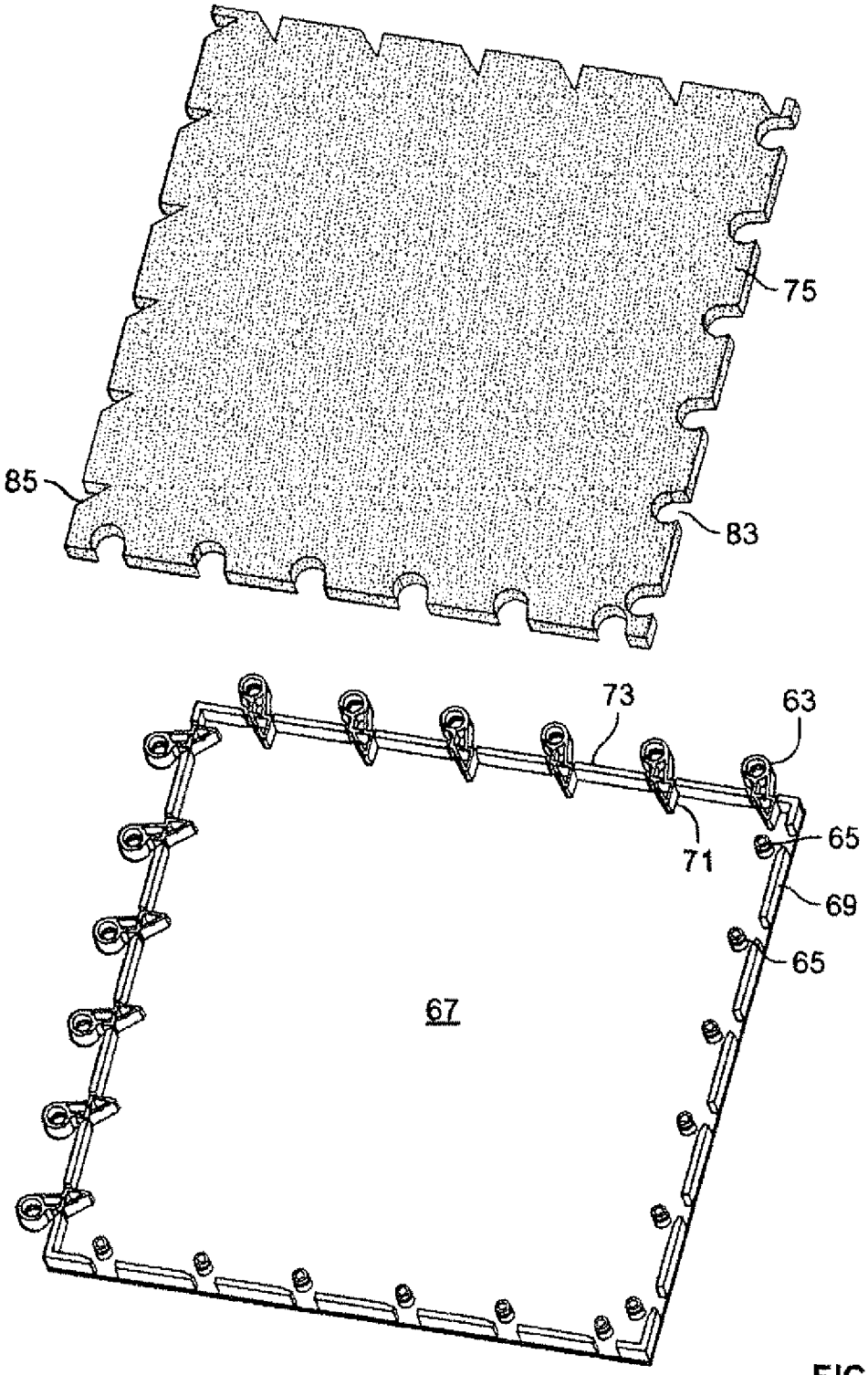
FIG. 12 shows an exploded perspective view of the interlocking modular mat with the sponge insert removed from the cavity of the interlocking modular mat.

FIGS. 7-12 show an alternative embodiment of the invention. In this embodiment, the mat is designated by the reference numeral 50. The mat has a mat body 51, top portion 52, tread design 53, and sides 55, 57, 59, and 61. The sides 55 and 57 include the female connectors 63 and the sides 59 and 61 include the male connectors 65, see FIGS. 10 and 11. As can be seen from FIGS. 10 and 11, the male connectors are only located on sides 59 and 61, unlike the connectors 15 in the FIG. 1 embodiment. An underside 67 is also shown in FIG. 12.

Figure 7:
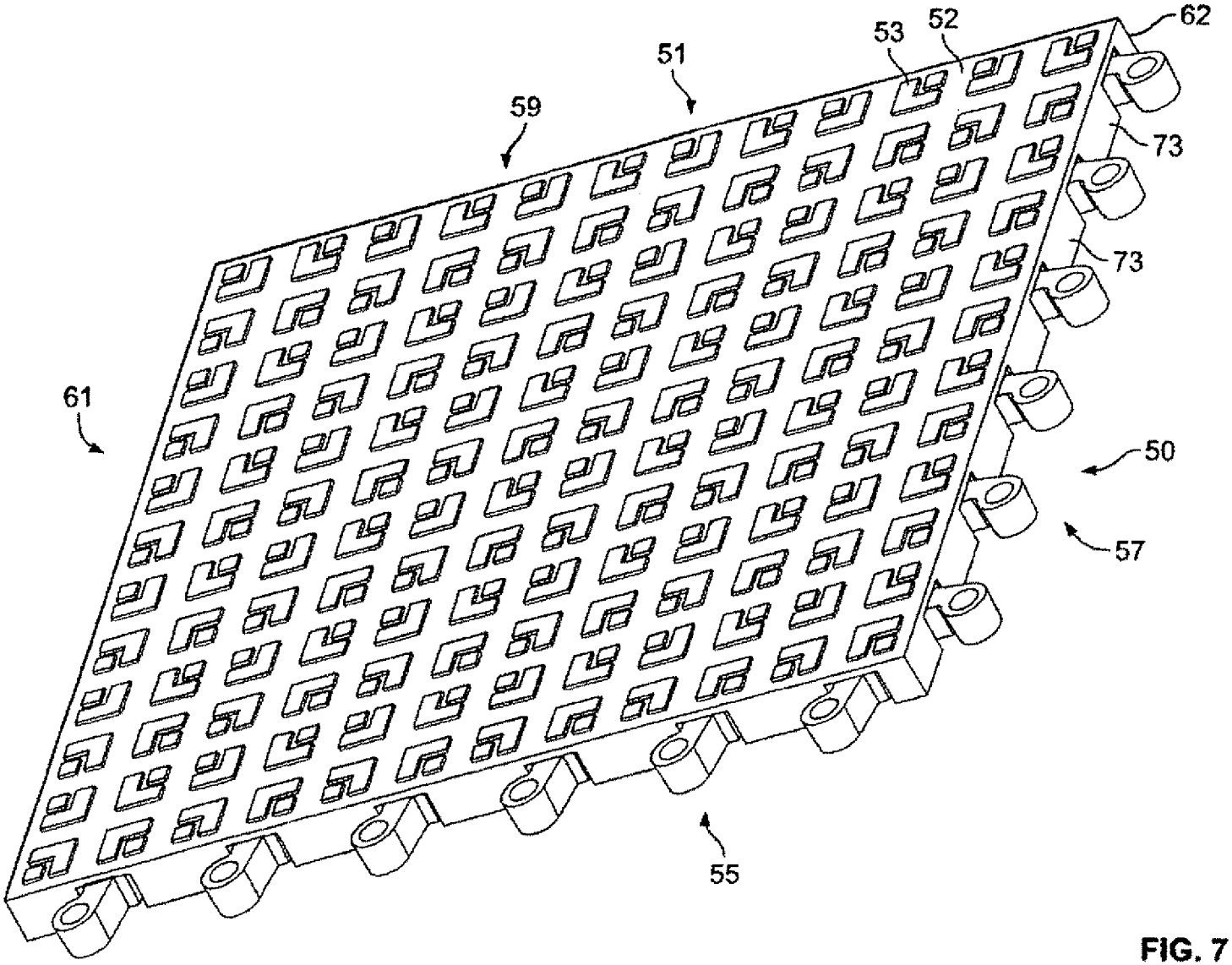
FIG. 7 is a perspective view of a top of a second embodiment of the interlocking modular mat showing the female connector sides thereof.
Figure 8:
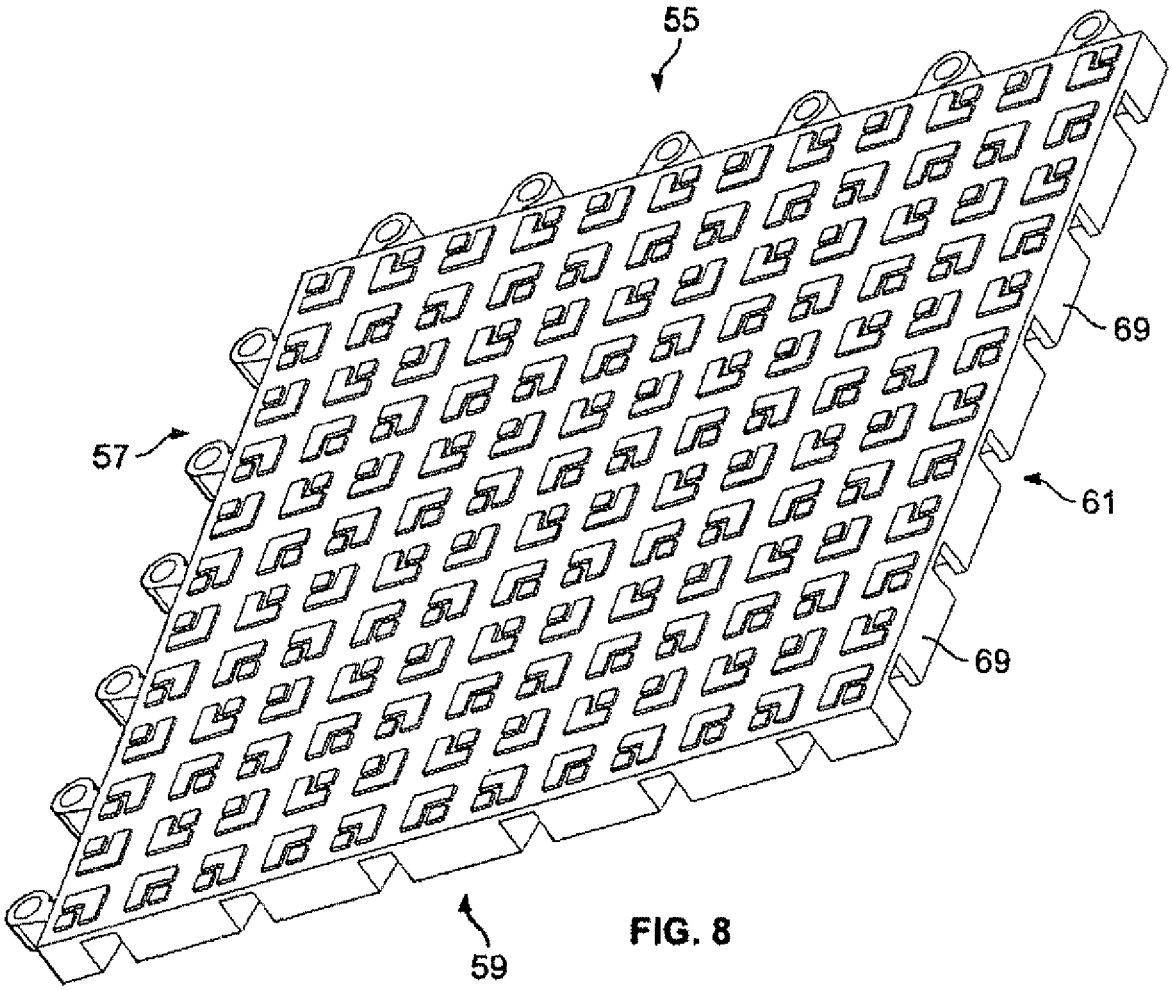
FIG. 8 is another perspective view of the top of the interlocking modular mat of FIG. 7 showing the male connector sides of the interlocking modular mat.
Figure 9:
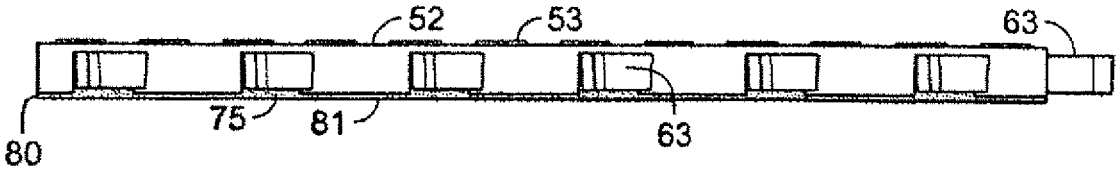
FIG. 9 shows a perspective view of the underside of the interlocking modular mat of FIG. 7.
Figure 10:
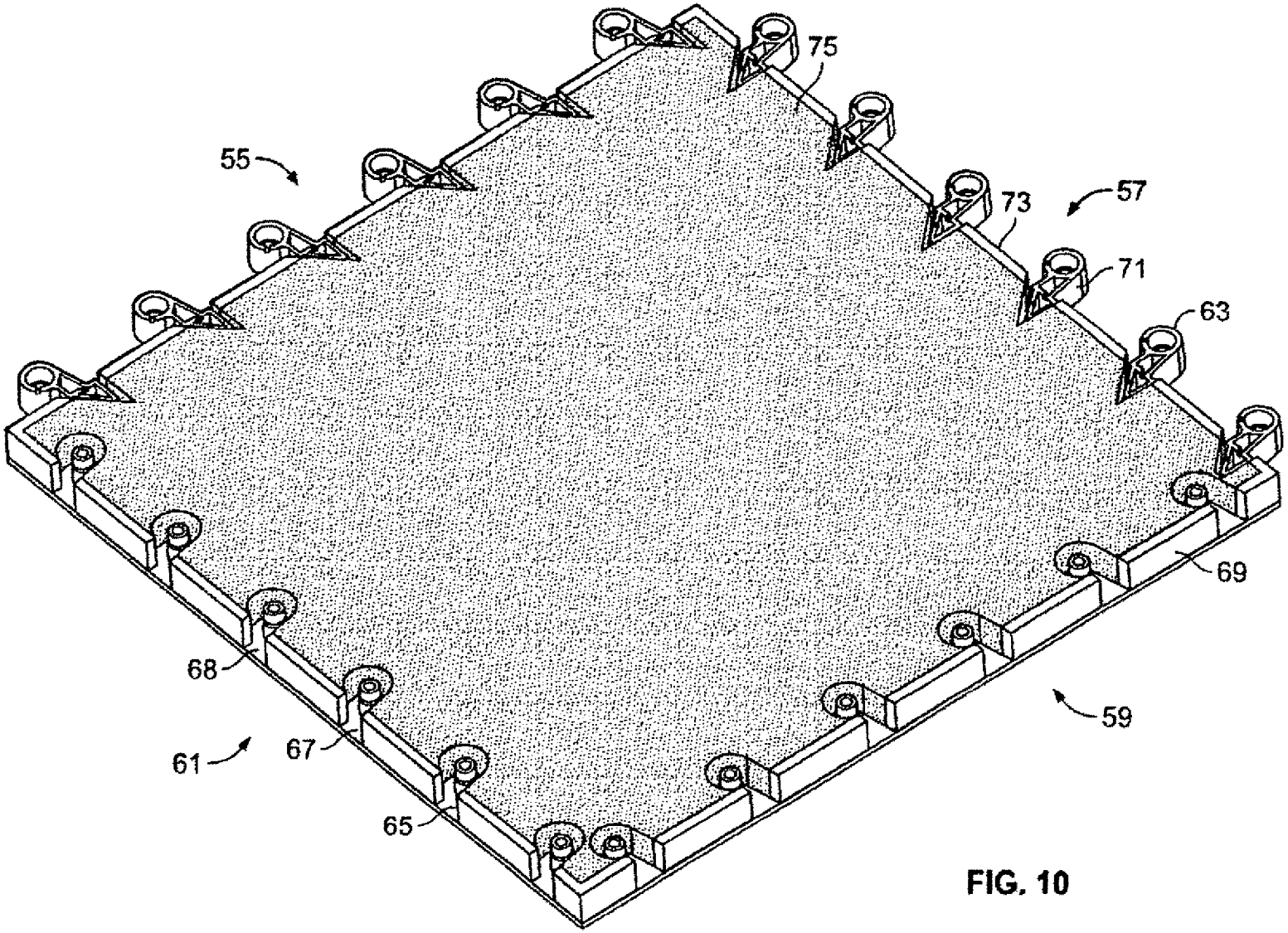
FIG. 10 shows a plan view of the underside of the interlocking modular mat of FIG. 7.
Figure 11:
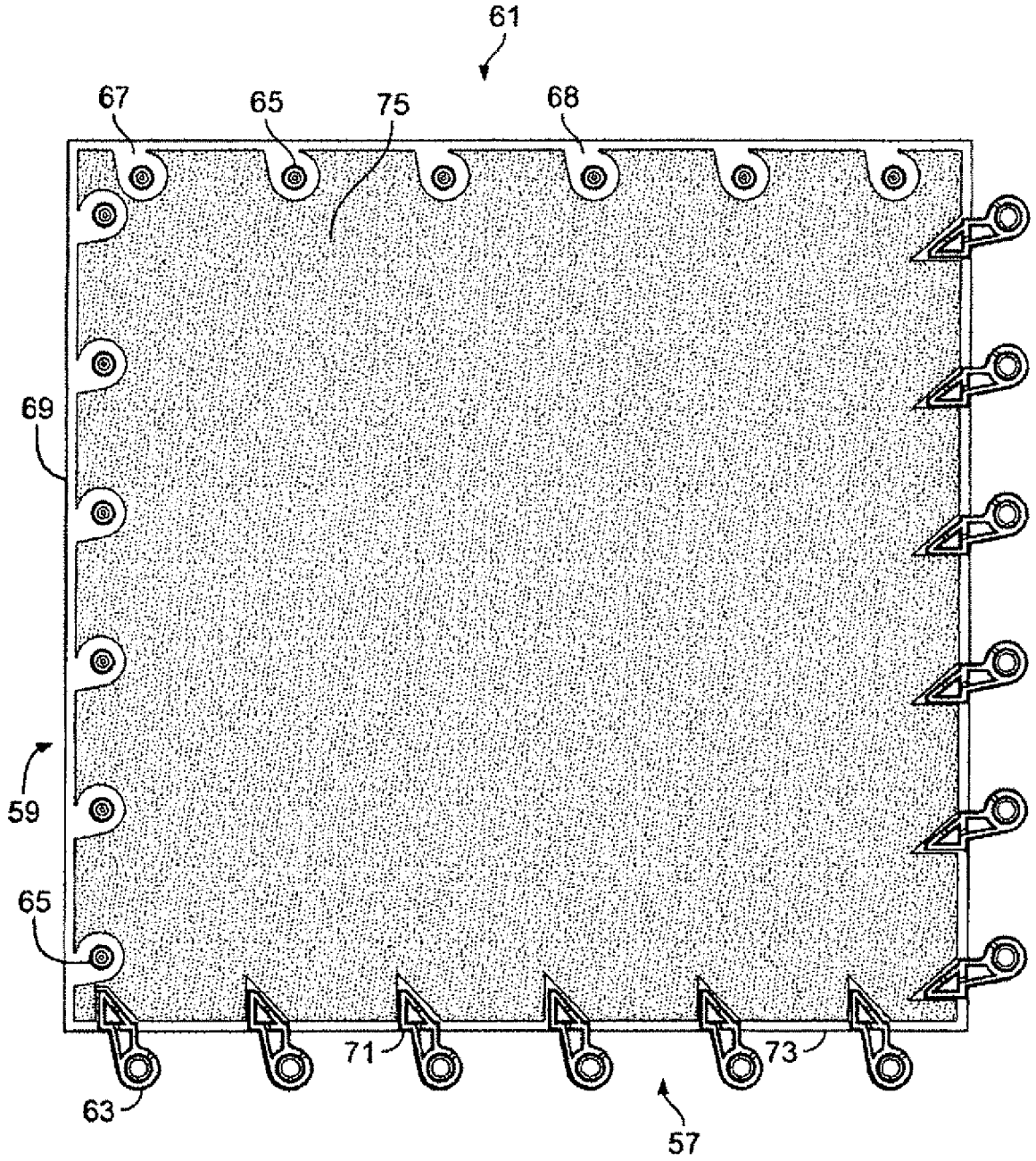
FIG. 11 shows a side view of the interlocking modular mat showing the sponge insert extending from a bottom of the interlocking modular mat bottom surfaces.

A main difference between the embodiments of FIGS. 1 and 7 is the configuration of the wall structures that extend around a periphery 62 of the modular mat 50. In the FIG. 1 embodiment, the wall structures are hollow and rectangular in shape with reinforcing ribs. In the FIG. 7 embodiment, the wall structures are solid and more like an extension of the top portion of the modular mat.

In modular mat 50, a number of wall segments are provided along the periphery 62 of the mat body. For the male connector sides 59 and 61, see FIGS. 8 and 10 for example, the wall segments 69 are spaced apart in similar fashion as wall structures 21 in FIG. 3 to allow access to the male connectors 65 for connection to the female connectors of an adjacent mat.

For the female connector sides, 55 and 57, there are wall structures 71, the wall structures spaced apart as their primary function is to anchor the female connectors 63 to the modular mat 50. In the FIG. 1 embodiment, the wall structures 19 were configured to assist in creation of the cavity 31 as well as provide a mounting for the female connectors 13. For the FIG. 7 embodiment, the wall structures 71 act more as a way to mount the female connectors 63 to the modular mat 50. Also provided on the female connector sides 55 and 57 are wall segments 73 that extend between adjacent female connectors 63. While the wall segments 73 are shown as spanning the space between the female connectors 63, the wall segments 73 could occupy only a portion of the space between adjacent female connectors 63, similar to wall segments 69 on the male connector sides of the mat body 51.

Figure 4:
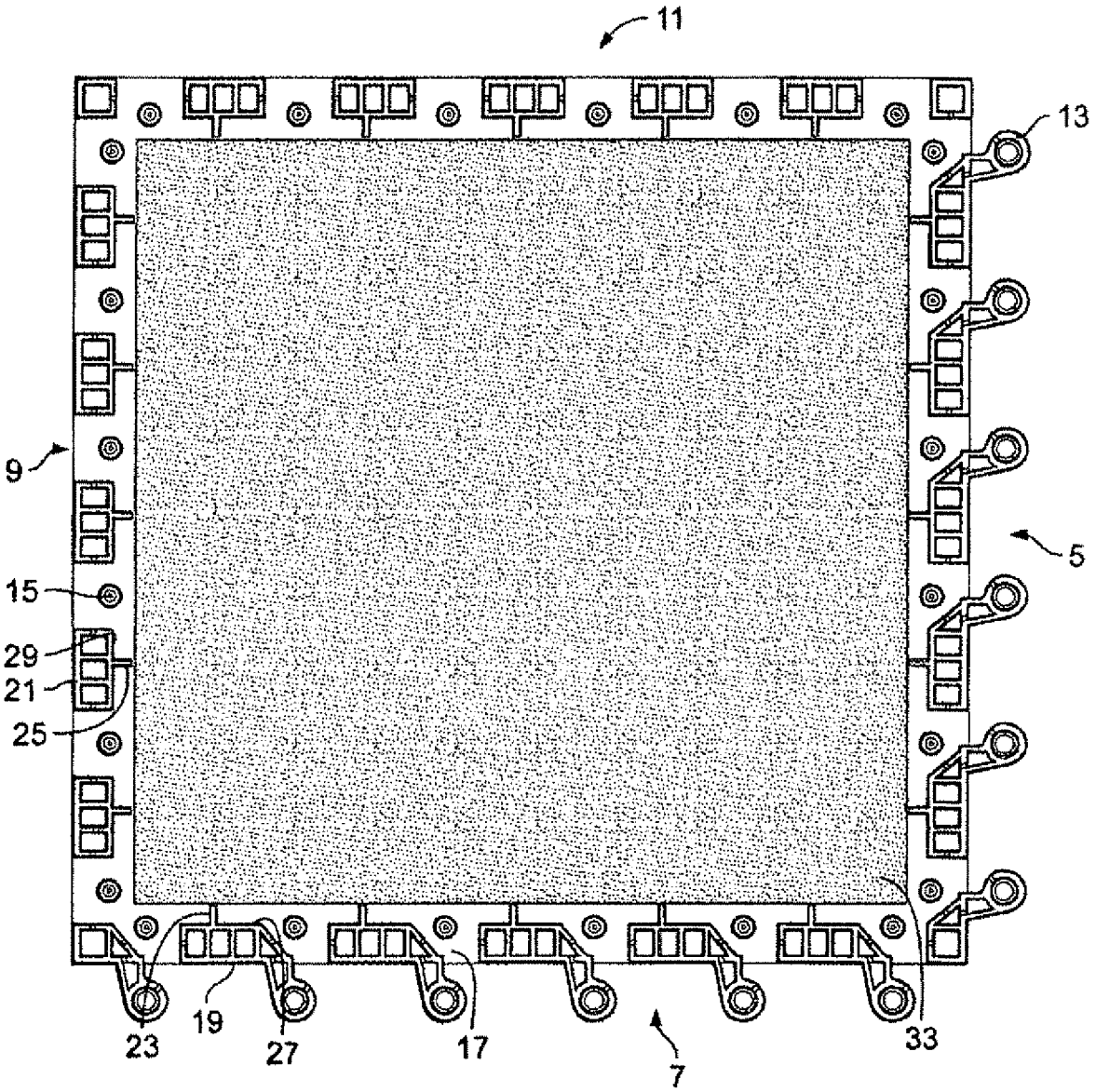
FIG. 4 shows a plan view of the underside of the interlocking modular mat of FIG. 1.
Figure 5:
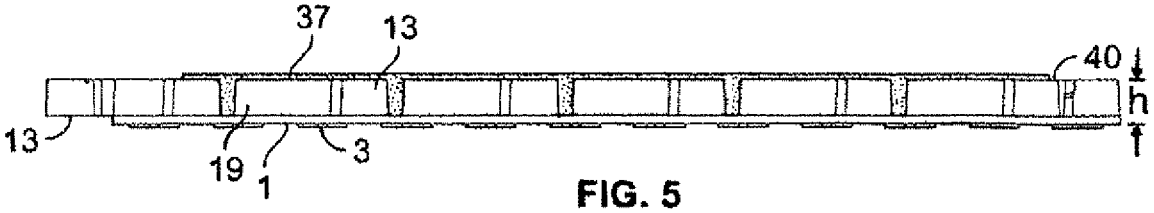
FIG. 5 shows a side view of the interlocking modular mat showing the sponge insert extending from a bottom of the interlocking modular mat.

Similar to FIGS. 3, 4, and 6, a sponge insert 75 is provided to occupy the cavity 77 formed by the wall segments 69 and 73, see FIG. 12. The sponge insert is sized in the same manner as the sponge insert of the FIG. 1 embodiment, which is shown in FIG. 5. That is, the sponge insert extension is designated by the reference numeral 80, see FIG. 8, and it extends below the bottom 79 of the female connector 63 and the bottom 81 of the wall segment 73 to provide the cushioned affect for a user without compromising the structural integrity of the modular mat or losing the connection ability with adjacent modular mats. In the embodiment of FIG. 7, since the sponge insert is sized to extend to the wall segments of the modular mat 50, the sponge insert has cutouts 83 for the male connectors 65 and cutouts for the wall structures 71 of the female connectors 63, see FIG. 12. This contrasts with the sponge insert 33 of the FIG. 1 embodiment, wherein a contiguous peripheral wall 35 extends around the periphery of the sponge insert. It should also be noted that the wall segments 69 and 73 could be made in different heights from each other and collectively, e.g., such that the male and female connectors would extend the furthest in length from the top portion of the mat body.

The sponge insert can be made of any resilient material as can the molded modular mat. The material of the sponge should be more resilient than the material of the mat so that the cushioning effect of the sponge is felt when the mat is being used. If the sponge material were like the material of the mat, the cushioning provided by the sponge material carrying the load or most of the load on the mat would be non-existent. The sponge material should not be so soft that it compresses to the point that the bottom surfaces of the mat components like the wall segments, wall structures, etc. take the load placed on the mat. An example of such a material for the sponge insert would be a PVC/NBR foam and an example of the material for the modular mat would be a flexible PVC, with these two materials providing the necessary difference in resiliency to provide the cushioning effect of the modular mat.

While the sponge insert is shown in one piece, it could be made into segments, e.g., four segments to occupy the cavity. Also, while the sponge insert is shown as one material, it could be made as a laminate to obtain the desired resiliency.

Also, although the cavities 31 and 77 are shown without any structure extending from the underside of the top portion of the mat, extending structures could be used if a need for such structures were needed for a particular mat application, e.g., include a post extending from the underside of the top portion of the mat in the center thereof to provide more support in the center of the mat. In this instance, the sponge insert would have the appropriate opening(s) to accommodate any structures extending from the underside of the top portion in the cavity space.

The configurations of the female connectors and male connectors are exemplary of typical peg and hole connection used for modular mats and other configurations/locations could be employed that use a peg of some type for the male connection and a hole-containing structure for the female connection.

The sponge insert can be located in the cavity by a press fit, wherein the sponge would be made a little larger than the inside surfaces of the mat body forming the cavity so that it would be compressed slightly so as to be held in place. The sponge insert can also be mounted in the cavity using an adhesive as well, e.g., glue the sponge to the underside of the mat top portion. A mechanical attachment or combination of mechanical attachment and adhesive could also be employed.

Methods of molding the modular mat or making these types of mats are well known and further detailed as to how the modular mats are made are not necessary for understanding of the invention.

In the method of using the interlocking modular mat, a plurality of mat bodies can be provided the mat bodies can be interlocked by engagement between male connectors/female connectors of one mat with female connectors/male connectors of another mat and this interlocking can be repeated with other mat bodies until a mat assembly of a desired size is created.

The invention provides a significant advantage in terms of comfort and ease of use of modular mats as the sponge insert gives the mat bodies a more cushioned feel, while at the same time, the mats retain their interlocking capability and peripheral integrity. With the sponge insert extension, the bottom of the sponge insert, i.e., the side away from the side facing the underside of the top portion of the mat becomes the general support surface for the modular mat when in use. While the outer peripheral structure of the mat body may bear the weight of the use if the weight is concentrated directly over a particular peripheral structure(s), e.g. a female connector, overall, the sponge insert will provide more of the support and provide an improved feel of the modular mat in use.

As such, an invention has been disclosed in terms of preferred embodiments thereof which fulfills each and every one of the objects of the present invention as set forth above and provides a new and improved interlocking modular mat and method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. An interlocking modular mat comprising:

a mat body, the mat body having a top portion, a wall structure extending downwardly from a peripheral edge of the top portion, and male and female connectors to allow the mat body to interlock to an adjacent mat body, each of the wall structure and the male and female connectors having a bottom surface, the wall structure forming a cavity with an underside of the top portion, and a sponge insert sized to fit within the cavity formed by the underside of the top portion and the wall structure, wherein the wall structure and each of the male and female connectors are all laterally outside of the sponge insert, and the female connectors are laterally outside the wall structure, the sponge insert having a sponge insert height dimension such that when in the cavity, a bottom portion of the sponge insert extends vertically beyond the bottom surfaces of each of the wall structure and the male and female connectors such that:

the sponge insert providing a more cushioned feel when a weight from a mat user is applied to the top portion and sponge insert; and when a weight from a mat user is applied over the wall structure and the male and female connectors, a structural integrity of the wall structure and male and female connectors and a connection with an adjacent mat is maintained.

2. The interlocking modular mat of claim 1, wherein a periphery of sponge insert is a continuous wall to engage at least a portion of the wall structure.

3. The interlocking modular mat of claim 1, wherein a material of the sponge insert is different from a material of the mat body.

4. The interlocking modular mat of claim 3, wherein the material of the sponge insert is more resilient than the material of the mat body.

5. The interlocking modular mat of claim 1, wherein the bottom portion of the sponge insert extends beyond the bottom surfaces of the wall structure and the male and female connectors by about an eighth of an inch.

6. A method of assembling a plurality of mats into a mat assembly comprising:

a) providing a plurality of the interlocking modular mat of claim 1; and b) interlocking the connectors of one mat body to connectors of another and adjacent mat body.

7. The method of claim 6, wherein step (b) is repeated to interlock additional mat bodies to form the mat assembly.

8. An interlocking modular mat comprising:

a mat body, the mat body having a top portion, a wall structure extending downwardly from a peripheral edge of the top portion, the wall structure comprising four side walls along a periphery of the top portion, and male and female connectors to allow the mat body to interlock to an adjacent mat body, each of the wall structure and the male and female connectors having a bottom surface, the four side walls of wall structure forming a cavity with an underside of the top portion, and a sponge insert having four sides and sized to fit within the cavity formed by the underside of the top portion and the four side walls of the wall structure, each side wall of the wall structure facing a respective side of the sponge insert, wherein each side wall of the wall structure and each respective facing side of the sponge insert extend in a generally linear direction, wherein the wall structure and each of the male and female connectors are all laterally outside of the sponge insert, and the female connectors are laterally outside the wall structure, the sponge insert having a sponge insert height dimension such that when in the cavity, a bottom portion of the sponge insert extends vertically beyond the bottom surfaces of each of the wall structure and the male and female connectors such that:

the sponge insert providing a more cushioned feel when a weight from a mat user is applied to the top portion and sponge insert; and when a weight from a mat user is applied over the wall structure and the male and female connectors, a structural integrity of the wall structure and male and female connectors and a connection with an adjacent mat is maintained.

9. The interlocking modular mat of claim 8, wherein a periphery of sponge insert is a continuous wall.

10. The interlocking modular mat of claim 8, wherein a material of the sponge insert is different from a material of the mat body.

11. The interlocking modular mat of claim 10, wherein the material of the sponge insert is more resilient than the material of the mat body.

12. The interlocking modular mat of claim 8, wherein the bottom portion of the sponge insert extends beyond the bottom surfaces of the wall structure and the male and female connectors by about an eighth of an inch.

13. A method of assembling a plurality of mats into a mat assembly comprising:

a) providing a plurality of the interlocking modular mat of claim 8; and b) interlocking the connectors of one mat body to connectors of another and adjacent mat body.

14. The method of claim 13, wherein step (b) is repeated to interlock additional mat bodies to form the mat assembly.

* * * * *